United States Patent [19]

Nessfield et al.

[11] 4,099,640

[45] Jul. 11, 1978

[54] COLLAPSIBLE CONTAINERS

[75] Inventors: Stanley Nessfield, Tibthorpe; John Elliott Foster, Godalming; Martin Clive-Smith, London, all of England

[73] Assignee: Sea Containers, Ltd., London, England

[21] Appl. No.: 679,086

[22] Filed: Apr. 21, 1976

[30] Foreign Application Priority Data

Apr. 24, 1975 [GB] United Kingdom ..... 17126/75

[51] Int. Cl.[2] ..... B65D 7/24; B65D 87/00

[52] U.S. Cl. ..... 220/6; 220/1.5; 206/512

[58] Field of Search ..... 220/6, 1.5, 7, 4 F; 217/15, 47; 206/509, 511, 512

[56] References Cited

U.S. PATENT DOCUMENTS

| | | | |
|---|---|---|---|
| 3,529,741 | 9/1970 | Walker et al. | 220/1.5 X |
| 3,612,330 | 10/1971 | Baer | 220/6 X |
| 3,684,122 | 8/1972 | Bonomi | 220/1.5 |
| 3,765,556 | 10/1973 | Baer | 220/6 X |
| 3,958,713 | 5/1976 | Selz | 220/6 |
| 3,961,707 | 6/1976 | Lehr et al. | 206/512 X |
| 3,981,410 | 9/1976 | Schurch | 220/6 |
| 3,999,676 | 12/1976 | Trebilcock | 220/6 |

*Primary Examiner*—William Price
*Assistant Examiner*—Steven M. Pollard
*Attorney, Agent, or Firm*—William E. Sherwood

[57] ABSTRACT

A collapsible goods-shipping container of the type used for loading on ships, trailer, trucks or railroad cars has a base, side walls hinged at their lower edges to sides of the base for folding inwards one over the other onto the base, end walls incorporating corner posts by which they are pivoted to stub corner posts of the base for folding over the side walls in the collapsed condition and a roof or lid somewhat shorter than the overall length of the container and adapted to rest on the upper edges of the side and end walls, the roof being somewhat shorter than the base to enable the roof to be stowed under the folded end walls, the remainder of the roof being formed by top portions of the end walls. Sealing means are provided on the various components so as to exclude water when the container is in its erected condition.

13 Claims, 18 Drawing Figures

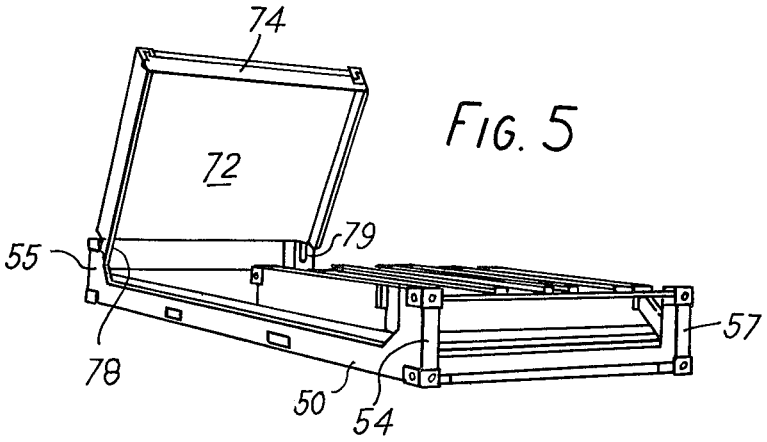
FIG. 5
FIG. 6
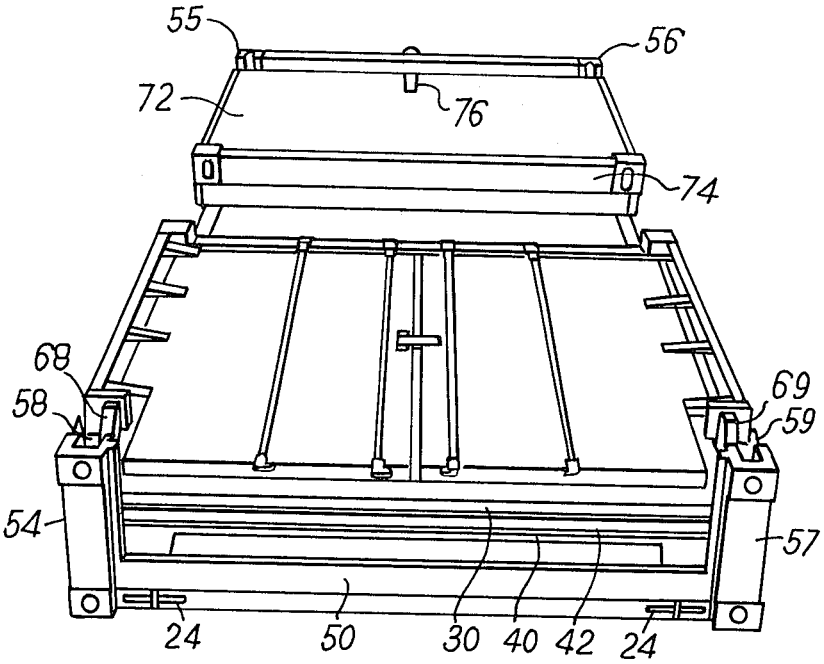

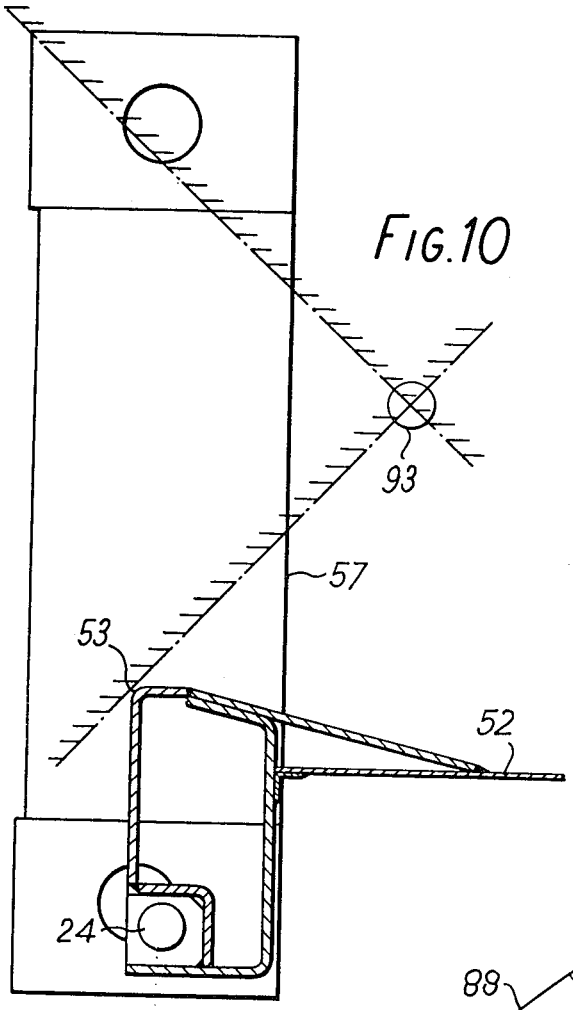
FIG. 10
FIG. 8
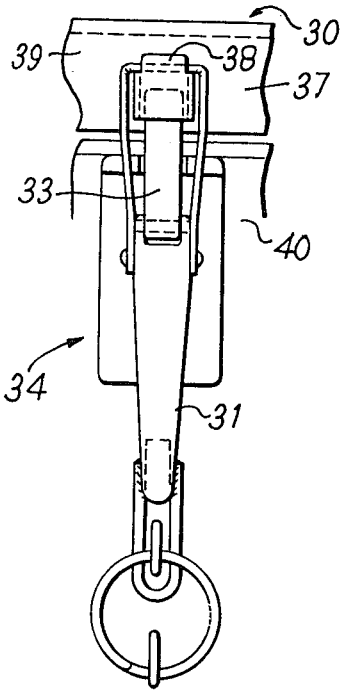
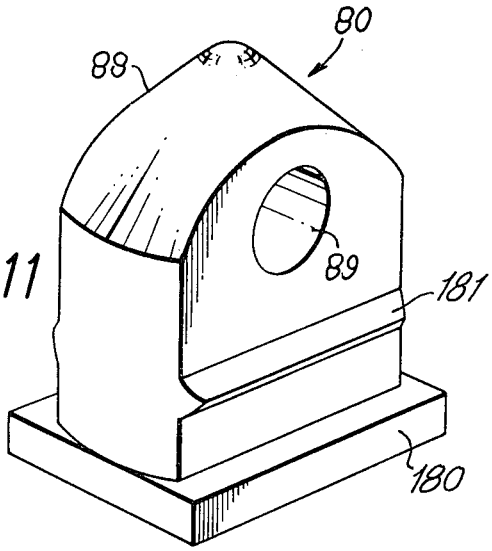
FIG. 11

COLLAPSIBLE CONTAINERS

BACKGROUND OF THE INVENTION

Field of the Invention

This invention relates to containers of the kind used for the transport of freight in so-called 'container-ships', or by rail or by road. Such containers are made to one of a few internationally agreed sizes and have caused great changes in the practice of cargo handling over the past 10 years or so. Proposals have been made from time to time for collapsible containers so that when there is an imbalance of trade between two points, empty containers can be collapsed to occupy a quarter or a fifth of the height of an erect container and so fewer ships, trains or lorries are required to return empty containers than to carry revenue-earning full containers. None of the proposed collapsible containers has yet had an impact on containerized freight handling.

There are several problems which a collapsible container must overcome to be satisfactory. Firstly it must comply with the dimensional tolerances specified by the agreed international standards. It must do so both when erect and when collapsed, (or at least a stack of collapsed containers must fit the dimensions laid down for an ordinary container). Secondly a container must be robust. A rigid container must withstand a fair amount of wear and tear from handling in transit which a collapsible container must be able to withstand as well. But a collapsible container must also be robust and simple to operate in its collapsing and re-erecting. Thirdly, there is always the question of cost. A collapsible container is bound to cost more than a rigid one but if its costs are too much greater than those of a rigid one than it will not be worth the savings available from return journeys in the collapsed position.

SUMMARY OF THE INVENTION

The present invention provides a collapsible container having a base, two pairs of opposed walls hinged to the base for folding inwardly on the base into a collapsed position, a roof member supported on the upper portions of the walls when the latter are erect, a stub corner post fixed vertically at each of four corners of the base, the top of each stub corner post being terminated in a bearing surface for supporting a corner post of a hinged wall of the container when the side wall is erect, each corner post being hinged to its stub corner post about an axis displaced from the stub corner post towards the interior of the container to thereby hinge the said wall to the base, the area of the roof member in plan being less than that of the base whereby the roof member may be positioned within the stub corner posts for stowage, the remainder of the container roof being formed by upper portions of at least some walls of the container.

The bearing surface at the top of each stub corner post has a longitudinally oriented slot extending around into an inner side wall, the slot being shaped to perform two functions; the first being to act as a top-lift anchorage to permit the handling of the container in the collapsed position by standard container-handling equipment, and the second function being to so accommodate an arm connecting the corner post to its hinge that in the erect position the corner posts standing on the stub corner posts which extend the stub corner posts to the full height of the container are positively positioned over the stub corner posts by each arm being engaged in its corresponding slot.

The container may include "cones" for aligning one collapsed container with another stacked on top of it. These "cones" should be arranged for a sliding fit into the slot of the stub posts (while the end walls are folded down so that their arms are not guided through the slots) and should be held captive on a chain or the like while the container is in the erect position. The "cones" can lock into the slots by dropping down after sliding fully home and in operation they will engage the bottom corner fittings of the container stacked above. A hole may be provided through the "cones" so that a locking pin can be used to lock the containers together so that the container handling machinery can handle a stack of collapsed containers safely by engaging only the top or the bottom container of the stack.

Preferably the lid is stored sandwiched in between the side walls and the end walls when the container is in the collapsed position. This has the advantage of keeping the relatively weak lid protected in the collapsed position. In the erect position the lid is fully supported around all four edges and is therefore strengthened by its support.

The side walls should be arranged so that they can be folded down in either order and likewise the lid should fit either way round.

BRIEF DESCRIPTION OF THE DRAWINGS

An embodiment of the present invention will now be described in detail, by way of example with reference to the accompanying drawings in which:

FIGS. 1 to 6 are a set of perspective sketches showing six steps in collapsing a container;

FIG. 8 is an elevation of a catch for holding down a container lid;

FIG. 10 is a diagram of constraints in positioning a hinge on a stub corner post; and FIG. 11 is a perspective view of a fixing "cone".

DESCRIPTION OF PREFERRED EMBODIMENT

Figure 1:
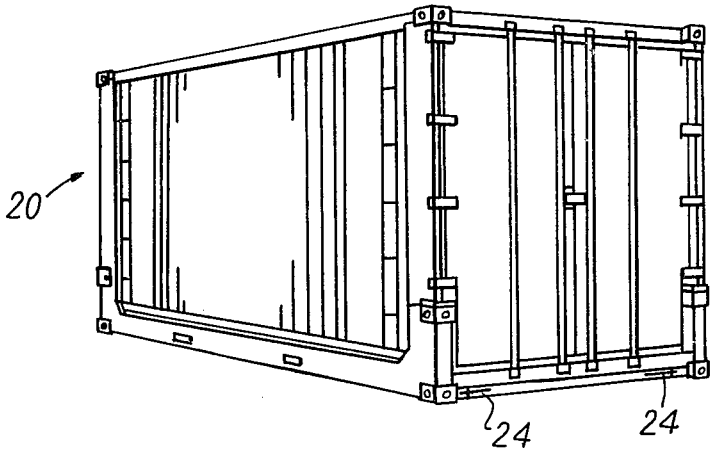

The container 20 shown in the drawings has a base 50, a roof 30, side walls 40 and 42 and end walls 62 and 72, the end wall 62 having doors 60, 61 providing access for loading and unloading the container when erect. The side walls 40 and 42, and the end walls 62 and 72 are all hinged to the base 50 to enable them to be folded inwards about horizontal axes.

Before describing the components of the container in greater detail, the sequence of operations involved in collapsing the container will first be described.

SEQUENCE OF OPERATIONS

Figure 2:
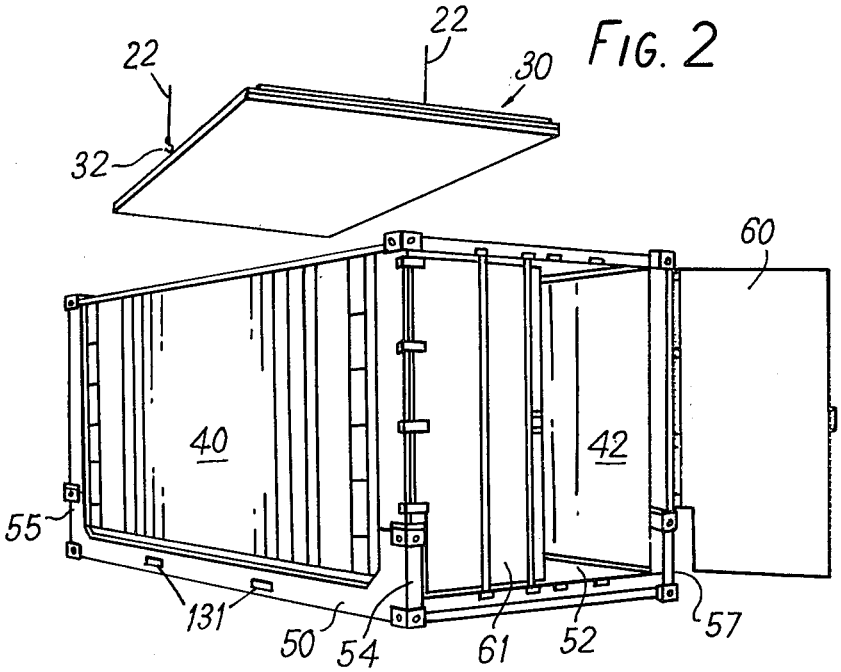
Figure 3:
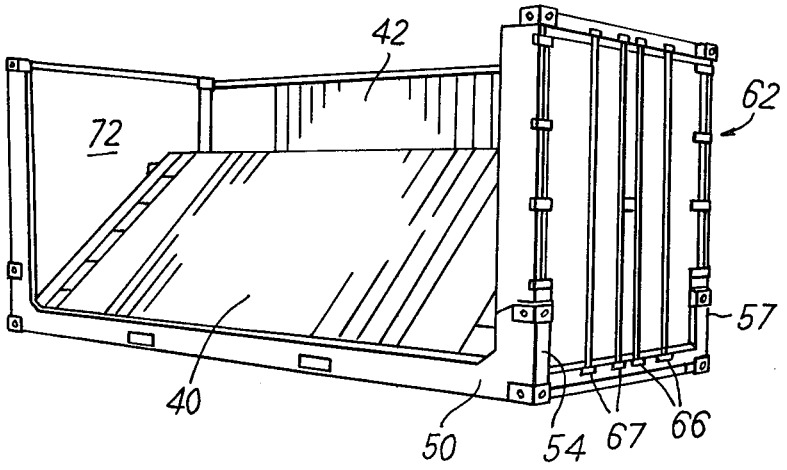
Figure 4:
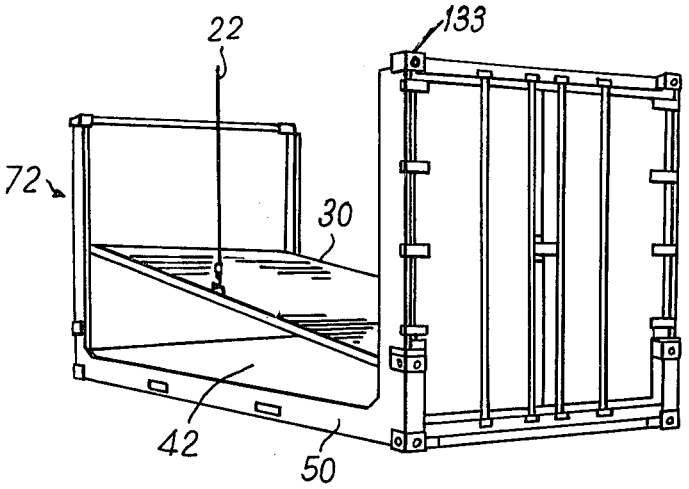

FIGS. 1 to 6 show a sequence of steps for collapsing a collapsible container. In FIG. 1 a container 20 is shown in its erect position. A first collapsing step is shown in FIG. 2 where a roof member, or lid 30 is shown lifted off the container 20 by crane wires 22 attached to points 32 on the lid 30. The lid 30 is normally held in place by six toggle fasteners 34 described in detail below. These must be released before the lid 30 is lifted off.

Although the purpose for having a lift-off lid 30 is to ease collapsing of the container 20 it does import two incidental advantages. The container 20 may be used as a top-loading container as well as the more normal front-loading type of container and, in the event of the lid being damaged, it is a simple matter to replace it.

Figure 16:
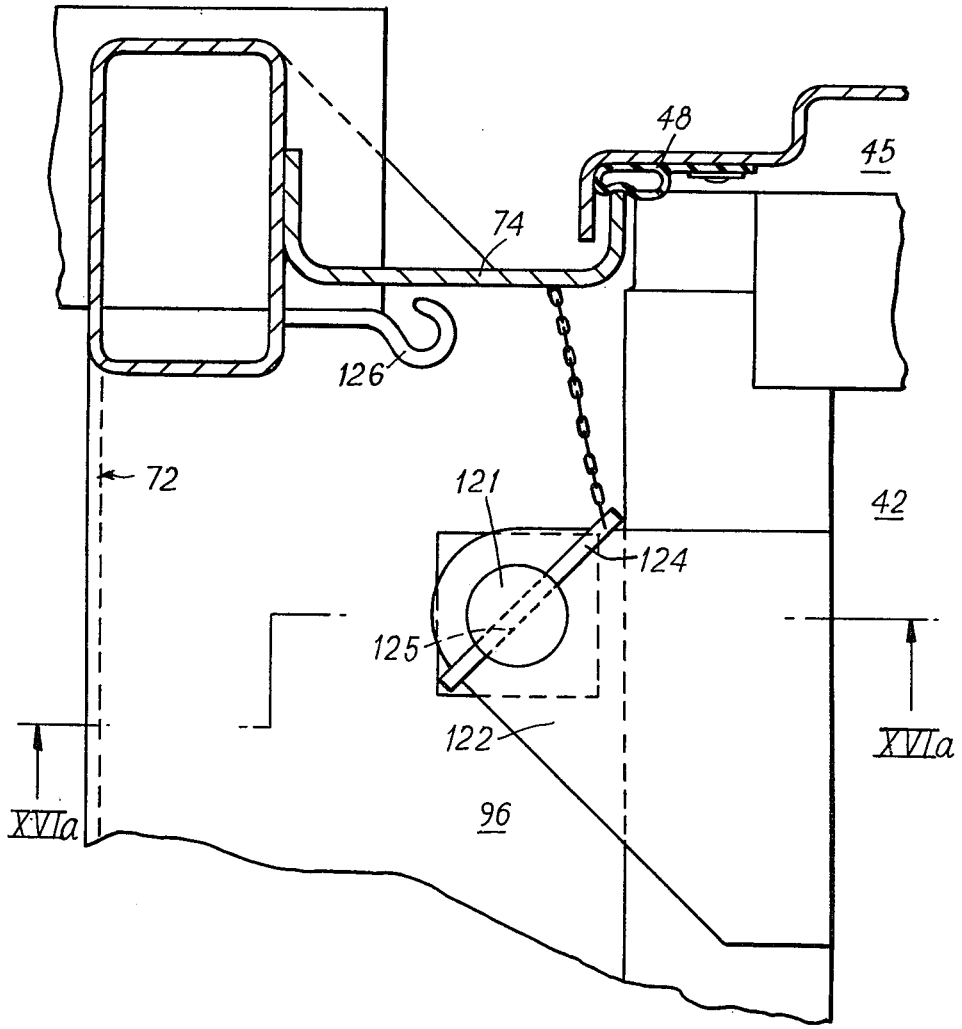
FIG. 16 shows how a top corner of a side wall is detachably secured to an end wall

After lifting off the lid 30 sides 40 and 42 of the container 20 are folded down onto a base 50. The sides are hinged at six points along their bottom edges to the base 50 and are held in the erect position by catches such as shown in FIG. 16 and located in the inside top corners of the container 20. Thus to fold down the sides 40 and 42 one of the doors 60 in the front end wall 62 must first be opened to allow a man inside the container to undo the catches. The sides are relatively light weight members of large surface area and once their retaining catches are undone they can be folded down simply by pushing them over. Wind resistance is sufficient to prevent any excessive speed and consequent damage. The sides 40, 42 may be folded down in either order; the first one down slopes down from its hinges onto a slightly recessed floor 52 of the base 50 while the second one down slopes up from its hinges to rest on the hinged edge of the other side.

The lid 30 is then lowered onto the folded sides 40, 42. To keep water out in the erect position the lid must overlap the ends of the container 20 as well as its sides, but in the collapsed position the lid 30 should be stored inside the collapsed "sandwich" to protect it while it is not fully supported all round its edges as it is in the erect position. To overcome this difficulty the end walls 62, 72 of the container 20 are provided with inwardly extending roof ledges 64, 74 so that they are closer to each other at the roof level than at base level. Then by tipping the lid 20 as it is lowered (see FIG. 4) it can be fitted between the end walls 62, 72 while overlapping the folded sides 40, 42.

The end walls 62, 72 are then folded inwards as shown in FIG. 5. These walls are heavy relative to their surface area and need lowering into the folded position rather than just being pushed over which is all that is needed for the sides 40, 42. The front end wall 62 is held up by fastening 66, 67 for its doors 60, 61 which therefore serve a dual purpose while the rear end wall 72 has a special fastening 76 (partially visible in FIG. 6) for holding itself up when the sides are folded.

The base 50 has four stub-posts 54, 55, 56 and 57, one at each corner, as best seen in FIG. 6. These posts are one fourth of the height of the container 20 so that four collapsed containers can be stacked in the same space as one erect container. With suitable refinement of the design it may become possible to reduce this height to one fifth so that five collapsed containers can be stacked, but clearly intermediate heights are not an attractive proposition because of the convenience of stacking collapsed containers in loads that occupy the volume of one erect container.

The stub-posts are equipped with standard-looking corner castings at both top and bottom ends. The bottom castings are indeed standard and need no further description but the top ones are modified. End and side holes are not necessary for these top castings, but may be included if desired, however, a top-lift fitting is required. The usual top oval hole is in this case slotted at one end to form an oval ended slot, such as 58 or 59. These slots provide an adequate purchase for handling the container in its collapsed state and the danger of a lifting device sliding out along the slot is avoided by using the fact that the opposite slot opens the other way. So long as there is a lengthwise rigid connection in the handling gear the slots are opposed and handling equipment remains engaged.

The purpose of the slots, combined with the channel section of the stub-posts is to allow supporting arms 68/69 and 78/79 of the end walls 62/72 respectively to support the end walls, when erect, from directly underneath them. The slots also act as guides to ensure correct lateral positioning of the end walls, and most important of all they allow the hinges of the end walls 62/72 to be nearer to the ends of the container 20 then would otherwise be possible. The importance of this feature is discussed below.

Erecting a container is simply carried out by going through the steps of FIGS. 1 to 6 in the reverse order. The lifting does not have to be done by a crane, it is easy to use a fork-lift instead.

To fix the containers of a stack of collapsed containers to each other to form a rigid container-sized unit four special "cones" 80 are used. These devices can be slid into the slots in the tops of the stub-posts 54 to 57 by engaging a pair of grooves 86, 87 below the slots and sliding home. The cone part 88 projects upwards for engaging into the bottom fittings of the next container and has a hole 89 for locking two containers together by means of a bolt 24 provided at each corner for that purpose. The base 50 of the upper container prevents lateral sliding of the cones 80 out of their slots once two containers are joined, and further protection from longitudinal sliding may be provided by shaping the grooves 86/87 so that the "cones" drop "home" when pushed fully into their slots. For this purpose, the base of each cone carries a pair of projections 180 which can slide through the notches **87*a* (FIG. 9) and then drop below the level of these notches until ribs 181 on the cones engage the top surfaces of the corner posts. The projections 180 are then out of register with the notches 87*a* and the cones are thereby prevented from sideways movement along the slots. The cones are retained in the container 20** on short lengths of chain so that they are not lost and provided with stowage positions near the bottoms of their stub-posts for use when the container is erect.

LID

Figure 7:
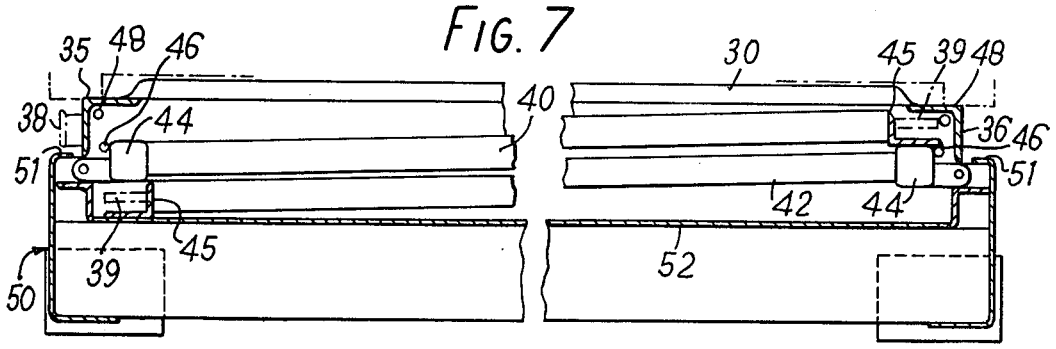
FIG. 7 is a cross-section through a collapsed container.

The lid 30 is made of corrugated steel sheet supported round its perimeter by edge beams of angle iron. On each of the side beams 35, 36 (FIG. 7) there are two outward projections such as 38 which are clamped down the sides when the container 20 is erect by means of one of the toggle fasteners 34. These fasteners (see FIG. 8) consist of a tongue 33 which slides into a recess in the bottom of the projection 38 and a loop 39 which is placed over the projection 38 and then pulled down to a clamped position by a lever 31. Various arrangements can be made to lock the lever 31 in the clamped position and the practice of customs officers for sealing containers with bonded goods should be taken into account.

Figure 15:
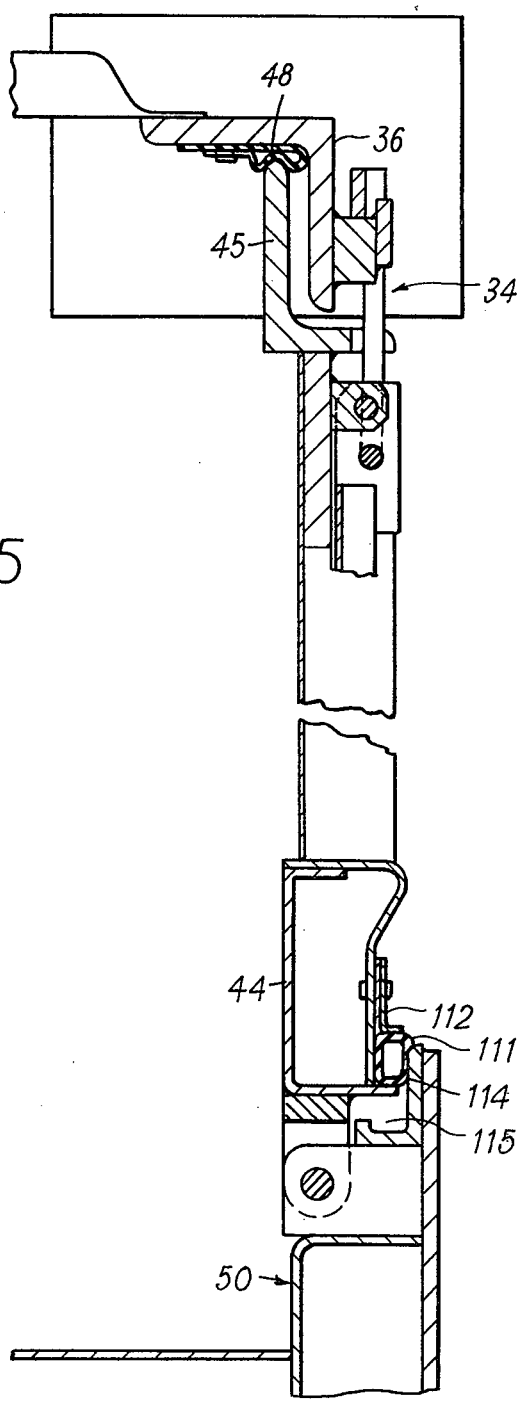
FIG. 15 is a vertical cross-section on the line XV—XV of FIG. 14.

Weather sealing is provided by tubes of neoprene 48 extending along the inside edges of the side beams 35/36, as best seen in FIG. 15, and also along similarly extending end beams.

SIDES

The sides 40/42 are also made of corrugated steel sheet and each has a bottom beam 44 of box section and a top beam 45 of angle section. The box section beams 44 are hinged to edges of the base 50 which are raised above the floor 52 by about the thickness of the sides 40/42. This is to allow the sides to be folded down in either order since the first side to be folded rests on the floor 52 below the hinge of the other side (see FIG. 7).

Along the bottom edge (in the erect position) of each of the box section beams 44 there runs a tube 46 of neoprene which is pressed against a sill 51 of the base 50 to provide a water-tight seal.

END WALLS

The main problem with the end walls is the location of the hinge axis about which they rotate. Both in the collapsed position and in the erect position the container must fit within the laid-down dimensions. This causes two constraints. Firstly the front edge of the end wall must lie either in the front plane of a container (when erect) or in a plane level with or below the top of the stub-posts (when collapsed). This means the hinge axis must be on or below a 45° line drawn from the outside top edge of the stub-post. Secondly the bottom edge of the end wall must not stick out beyond the end of the base 50 when the wall is folded down so the hinge axis must lie below a 45° line drawn up from the front edge of end sills 53 of the base 50.

This is illustrated in FIG. 10. Other desirable constraints on the hinge position are that it should be as close to the ends as possible to keep it out of the way of the sides when they fold and as high as possible to keep the supporting arms 68/69, 78/79 as short, and hence as strong, as possible.

The balance chosen in the limits allowable has been to raise the end sills 53 (causing the floor 52 to be in a well with edges all round) thereby raising and bringing forward the highest available hinge axis. With the axis so far forward the supporting arms 68 etc. have to go through part of the sub-posts when the container is erect. Some small further advantage can be achieved by moving the effective outside top corner of the stub-post back a little into the container. The effective point being where the bottom outside edge of the end wall meets the stub-post in the erect position.

Figure 9:
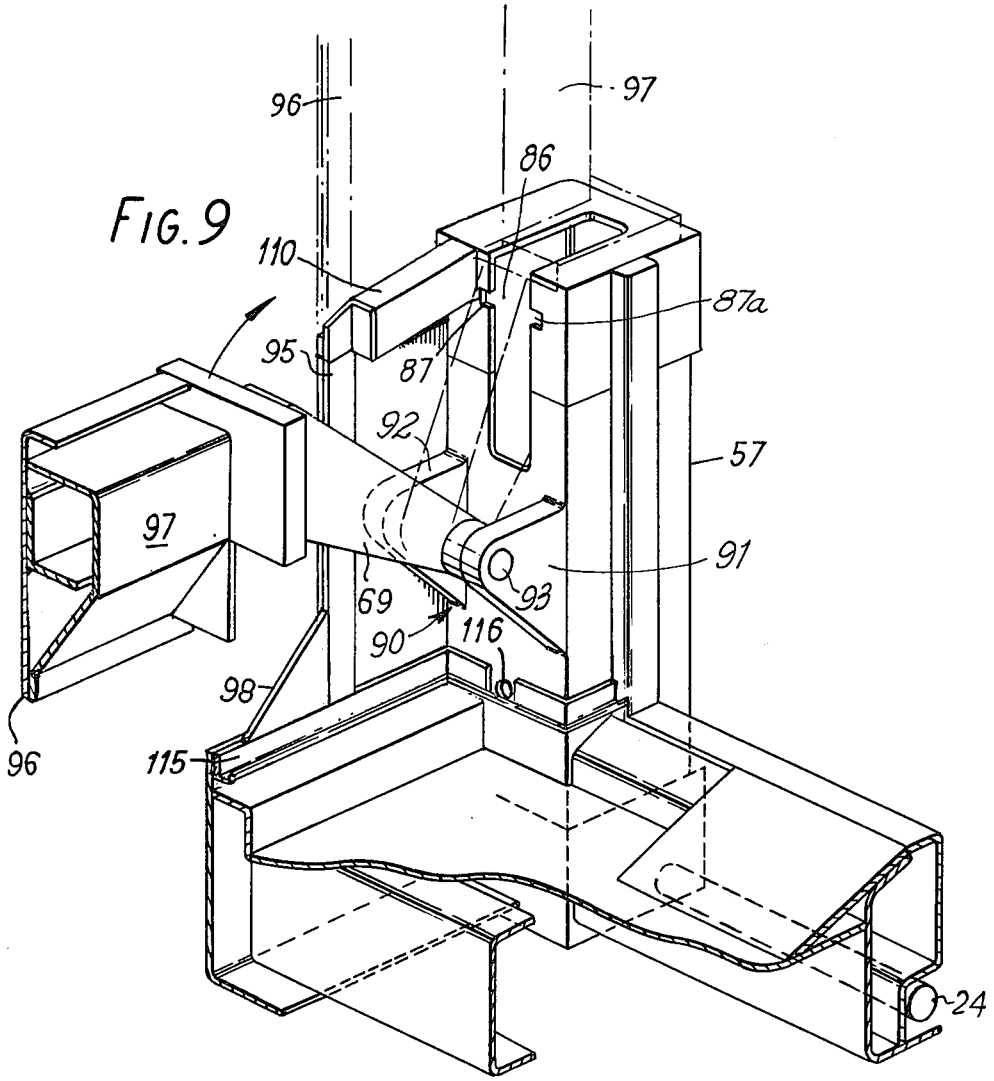
FIG. 9 is a perspective cut-away view of a stub corner post looking out from inside the container.

As can be seen in FIG. 9 the hinge 90 on the stub-post 57 consists of two triangular members 91, 92 with a simple pin 93 placed between them. There is a flange 95 connected to the stub-post 57 making up part of the side wall of the container and this is continued with a flange 96 all the way up a corner post 97 of the front end wall 62. The other three corners are of similar construction.

SEALING

The edges of the sides 40/42 and the lid 20 all have to be sealed against bad weather and sea water. This is done by means of neoprene tubing such as the tubes 46 which are compressed on erection of the container or by the tubes 48 which are compressed by the top edges of the top beams 45. Sealing tubes are provided along the vertical edges of the sides and the ends of the lid. A corner piece 98 is provided behind each of the stub-posts to ease transition between a bottom seal to a side seal.

MATERIALS

While the embodiment described is indeed made of steel with neoprene tubing for sealing purposes, it will be appreciated that collapsible containers can also be built of other materials. Similarly the preferred quantities of catches and hinges for the sides etc. is a matter of design choice and may be varied to suit prevailing requirements.

FIGS. 12 to 15 show sealing arrangements for preventing the ingress of water into the erect container and for collecting and removing any water which enters past the seals, for example as the result of minor damage to the latter.

Figure 12:
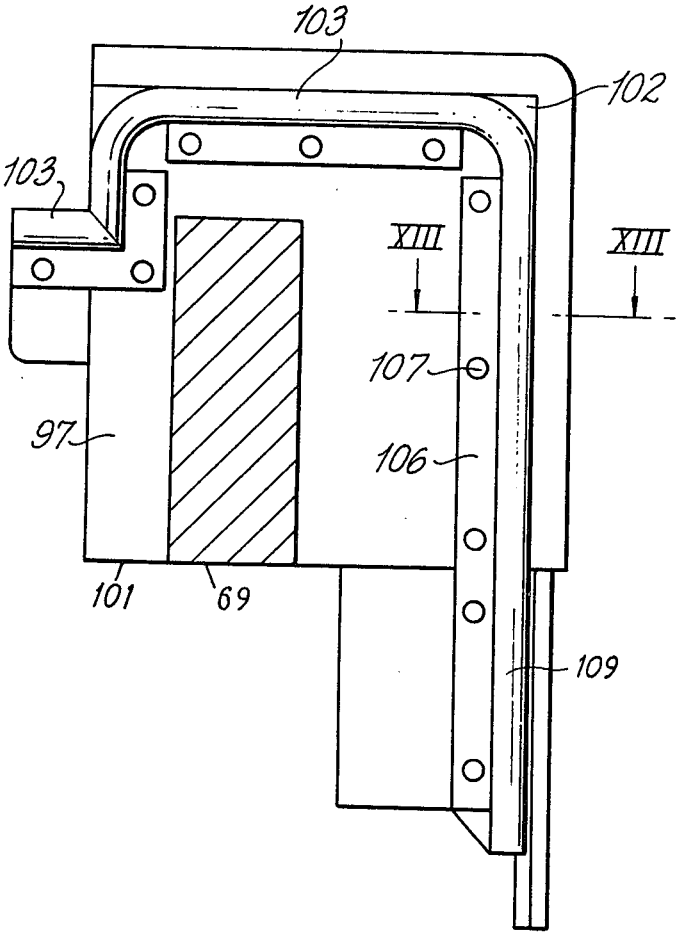
FIG. 12 is a view taken in the direction on the arrow XII of FIG. 9, of the underside of a side post of an end wall of the container.
Figure 13:
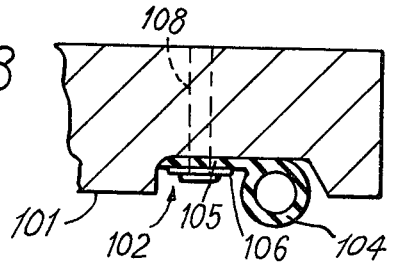
FIG. 13 is a fragmentary section on the line XIII—XIII of FIG. 12 on an enlarged scale.

FIGS. 12 and 13 show the sealing arrangement between the undersurface 101 of a corner post 97 and the top surface of its stub corner post 57. The surface 101 is formed with a wide and shallow groove 102 along two sides of the surface adjacent the outer sides of the corner post. The groove 102 accommodates a sealing member 103 of neoprene which as seen in section in FIG. 13 has a hollow circular portion 104 and a flat flange 105 clamped between aluminium alloy strips 106 and the top wall of the groove 102 by means of pop-rivets 107 engaged in blind bores 108.

As can be seen in FIG. 13, the circular section 103 projects below the face 101 and is therefore compressed when the face 101 comes into load bearing contact with the top surface of the stub corner post 57. The sealing member is continued in the direction towards the corresponding side wall 40 or 42 by a portion 109 which makes sealing contact with a block 110 (FIG. 9).

In the case of the end wall 72, the sealing member extends from one corner post along the underside of the end wall to the other corner post where it becomes integral with the sealing member of the other corner post. In between the two corner posts, it is secured to the underside of the end wall by further aluminium strips and pop-rivets.

Figure 14:
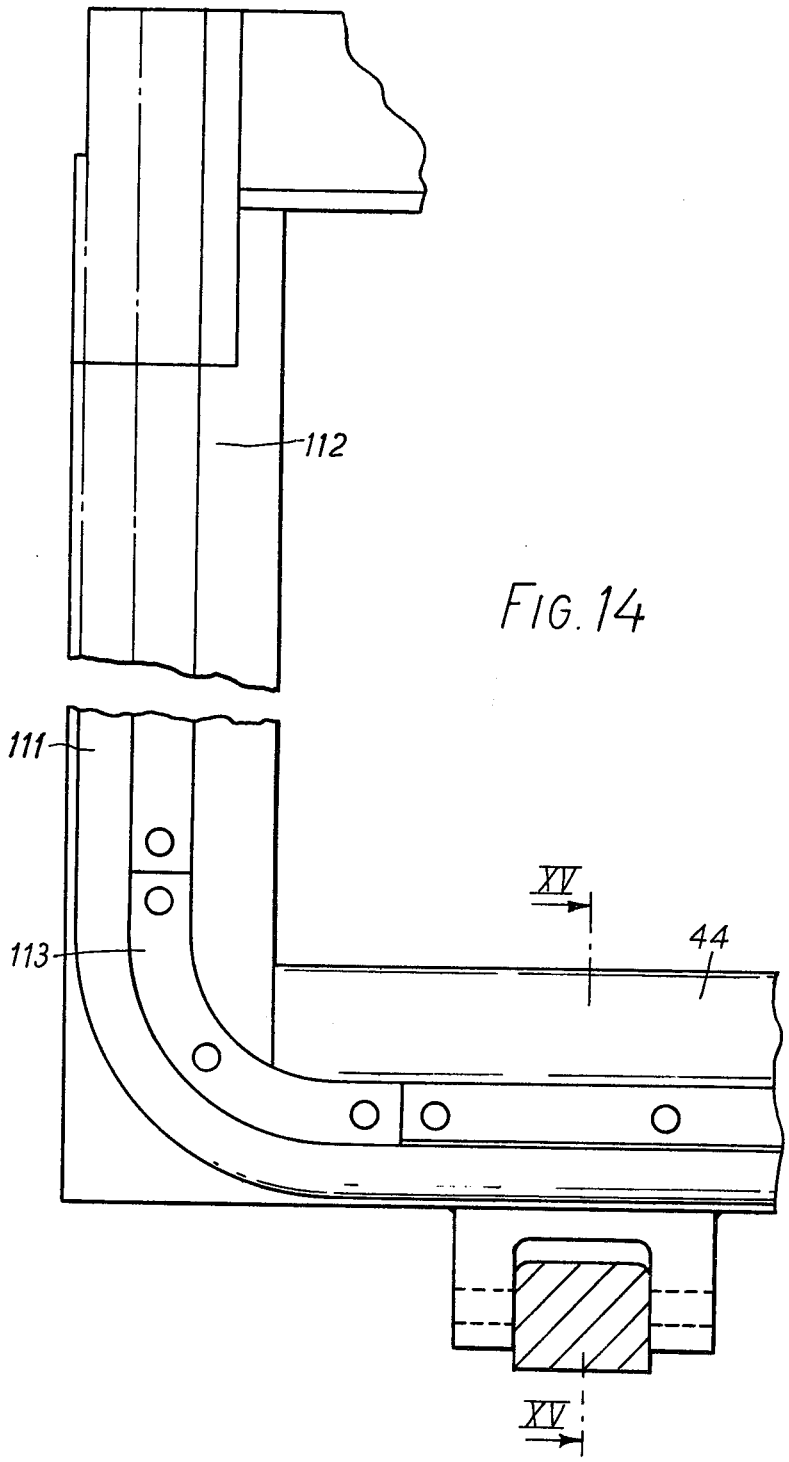
FIG. 14 shows a top corner and a bottom corner of one of the sides of the container in elevation.

FIGS. 14 and 15 show the preferred method of effecting a seal between the side walls 40 and 42 and both the base 50 and the corner post flanges 96. A continuous length of neoprene gasket 111 is a similar construction to that shown in FIG. 13 with the exception that its tubular portion (FIG. 15) is a somewhat flattened cross-section and is preferably corrugated at its sealing surface. The flange 112 of the strip is clamped against the outer surface of its side wall by aluminium strips which are either straight as shown at 112 or form quadrants of a circle as shown at 113. The bottom run of the sealing member 111 is compressed against an upper reinforced portion 114 of the container base which portion is continued downwards below the seal 111 to form a drip-collecting channel 115 which extends the full length of the container base between the two stub posts 57 which are formed with drain holes 116 (FIG. 9) which allow any liquid collected in the channel 115 to escape downwards through the stub posts.

The quadrant shaped portions of the sealing member 111 seal against flat inner surfaces of the stub post flanges 95 while its vertical runs seal against the inner surfaces of the flanges 96. In the erected condition of the container, the inner surfaces of the flanges 96 and 114 and of the side extensions 116 of the corner post 57 lie in one plane.

Figure 16A:
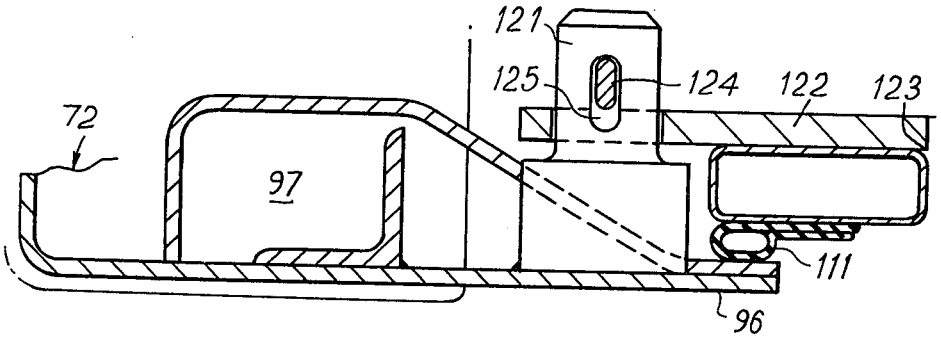
FIG. 16*a* is a sectional view taken on line XVI*a* of FIG. 16.

FIGS. 16 and 16*a* show the interiorly mounted, manually operated, catch connection which is made at one end of the top of the side wall 42 to the adjacent end wall, in this case 72. There, the flange 96 of the corner post 97 carries a substantial peg 121 which passes through an eye in a substantial tab 122 welded into the upright end member 123 of the side wall 42. A cotter 124 has a tapered profile and is tapped home into a correspondingly shaped cross bore 125 in the peg 121 to lock the side and end walls together. In the collapsed condition, the cotter 124 can be engaged on a hook 126.

Figure 17:
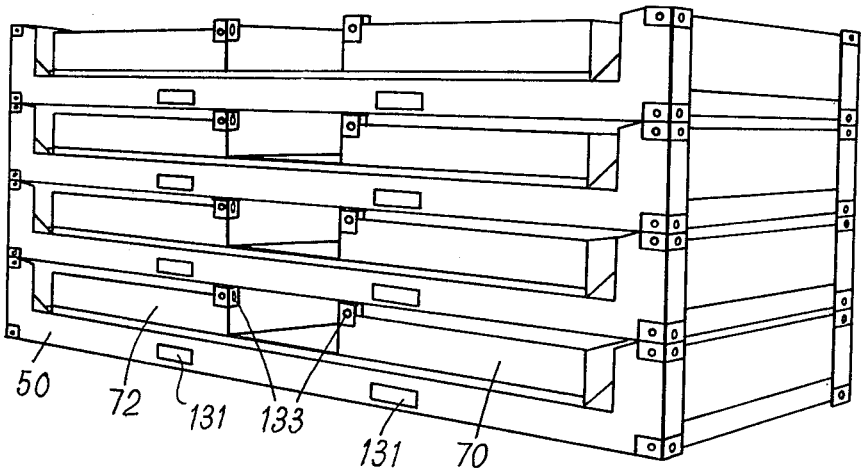
FIG. 17 shows a stack of four collapsed containers.

FIG. 17 shows a stack of four of the containers superimposed on each other in the collapsed condition. Each container base 50 has a pair of laterally extending channels 131 to receive the lifting fork of a 20 or 25 ton fork lift truck. In the collapsed condition, each base 50 has sufficient resilient flexibility to ensure that when the lifting fork of a fork lift truck is engaged in the channels 131 of the lowermost container base 50 to lift the stack of four collapsed containers connected by their cones, a major part of the lifting forces are transmitted to the superimposed base 50 through the top corner castings 133 of the corner posts 97 of the end walls 70 and 72, these corner castings engaging the underside of the superimposed container. However, when the lowermost container base 50 is resting on level ground, there is a clearance between the corner castings 133 and the superimposed container base.

We claim:

1. A collapsible container having a base, two pairs of opposed walls hinged to the base for folding inwardly on the base into a collapsed position, a detachable roof member supported on the upper portions of the walls when the latter are erect, a stub corner post fixed vertically at each of four corners of the base, the top of each stub corner post being terminated in a bearing surface for supporting a corner post of a hinged wall of the container when the side wall is erect, each corner post being hinged to its stub corner post about an axis displaced from the stub corner post towards the interior of the container to thereby hinge the said wall to the base, the area of the roof member in plan being less than that of the base whereby the roof member may be separately positioned within the stub corner posts for stowage, the remainder of the container roof being formed by upper portions of at least some walls of the container, said bearing surface at the top of each stub corner post having a longitudinally oriented slot extending around into an inner side wall, the slot being shaped to perform two functions; the first being to act as a top-lift anchorage to permit the handling of the container in the collapsed position by standard container-handling equipment, and the second function being to so accommodate an arm connecting the corner post to its hinge that in the erect position the corner posts standing on the stub corner posts which extend the stub corner posts to the full height of the container are positively positioned over the stub corner posts by said arm being engaged in its corresponding slot.

2. A collapsible container according to claim 1 wherein the tops of the stub corner posts and the corner posts are formed as standardised connecting elements, and the underside of the container base has corresponding standardised coupling elements whereby to enable the base of a superimposed identical collapsible container to be coupled selectively to the stub corner posts of the container (when collapsed) or the corner posts of the container when erected.

3. A container according to claim 1 including means for aligning one collapsed container with another stacked on top of it.

4. A container according to claim 3, wherein the aligning means are arranged for a sliding fit into the slots of the stub posts while the end walls are folded down so that their arms are not guided through the slots.

5. A container according to claim 4, wherein a hole is provided through the aligning means so that a locking pin can be used to lock the containers together so that the container handling machinery can handle a stack of collapsed containers safely by engaging only the top or the bottom container of the stack.

6. A container according to claim 1, wherein the walls are arranged so that the walls of each pair can be folded down in either order.

7. A collapsible container having a base, side walls hinged to the base for folding one over the other on the base in a collapsed position, end walls including corner posts, the end walls being hinged to the base for folding over the side walls in the collapsed position, and a stub corner post fixed vertically at each of four corners of the base, the top of each stub corner post being terminated in a surface having a longitudinally oriented slot, the slot accommodating arm connecting the end wall to its hinge so that in the erect position the end wall corner posts stand on the stub corner posts to extend the stub corner posts to the full height of the container, the corner posts being positively positioned over the stub corner posts by each arm being engaged in its corresponding slot.

8. A collapsible container according to claim 7 and including sealing means between the side walls and the base, between the side walls and the stub corner posts, between the corner posts and the stub corner posts, between the side walls and the corner posts and between the end walls and the base.

9. A collapsible container according to claim 8, wherein the sealing means between the side wall and the other components comprise a resilient sealing strip having a horizontal bottom run connected by two corner portions to vertical runs at either end of the said wall.

10. A collapsible container according to claim 8, wherein the sealing means between each corner post and its stub corner post are located in a groove in the underside of the corner posts.

11. A collapsible container according to claim 10, wherein the sealing means of two corner posts of one end are integral with the sealing means between that end and the base.

12. A collapsible container according to claim 7 wherein the height of the stub corner posts is such that when a second container is superimposed on the collapsed container, the weight of the second container is carried solely by the stub corner posts of the first container.

13. A collapsible container according to claim 12, wherein the container base has lifting points intermediate its ends and the container base is sufficiently flexible to ensure that when a stack of four identical collapsed containers is lifted by the lifting points of the lowest, part of the weight of the superimposed containers are transmitted to the lowest container by contact between top edge portions of folded walls of the lowest container being abutted by the base of the next superimposed container.

* * * * *